US010589900B2

(12) United States Patent
Toh et al.

(10) Patent No.: US 10,589,900 B2
(45) Date of Patent: Mar. 17, 2020

(54) BOTTLE

(71) Applicant: COLGATE-PALMOLIVE COMPANY, New York, NY (US)

(72) Inventors: Kiat-Cheong Toh, Forest Hills, NY (US); Claudia Daniela Macias Mejia, Guanajuato (MX); Jorge Becerra, La Joya (MX); Luis Rodolfo Arevalo Pliego, Santa Fe Juriquilla Queretaro (MX); John Lamb, Pewsey (GB); Corinne Elizabeth Ashbee, Marlborough (GB)

(73) Assignee: Colgate-Palmolive Company, New York, NY (US)

( * ) Notice: Subject to any disclaimer, the term of this patent is extended or adjusted under 35 U.S.C. 154(b) by 113 days.

(21) Appl. No.: 15/506,191

(22) PCT Filed: Aug. 27, 2014

(86) PCT No.: PCT/US2014/052945

§ 371 (c)(1),
(2) Date: Feb. 23, 2017

(87) PCT Pub. No.: WO2016/032460

PCT Pub. Date: Mar. 3, 2016

(65) Prior Publication Data

US 2017/0240317 A1 Aug. 24, 2017

(51) Int. Cl.
*B65D 23/10* (2006.01)
*B65D 1/02* (2006.01)
(Continued)

(52) U.S. Cl.
CPC ..... *B65D 23/102* (2013.01); *B65D 1/0246* (2013.01); *B65D 25/205* (2013.01); *B65D 41/16* (2013.01); *B65D 43/16* (2013.01)

(58) Field of Classification Search
CPC ..... B65D 23/102; B65D 23/00; B65D 35/04
See application file for complete search history.

(56) References Cited

U.S. PATENT DOCUMENTS 5,052,567 A 10/1991 Colani
5,156,285 A 10/1992 Zogg et al.
(Continued)

FOREIGN PATENT DOCUMENTS

FR 2 997 494 5/2014
WO WO-2012/130529 A1 10/2012

OTHER PUBLICATIONS

International Search Report and the Written Opinion of the International Searching Authority issued in International Application PCT/US2014/052945 dated Feb. 24, 2015.

*Primary Examiner* — Andrew T Kirsch
*Assistant Examiner* — Don M Anderson

(57) ABSTRACT

A bottle (2) having a body portion (4) which comprises first and second major faces (22,24), each extending substantially along the length of the body portion, which are opposite to each other and mutually separated on opposite sides of a first central plane (P1-P1) of the bottle by a spacing (25), wherein the spacing decreases proceeding from the lower end (10) to a central portion (12) and from the central portion to the upper end (14). The bottle further comprises a recess (32) in the first major face (22), the recess being shaped to receive an adult human thumb, the recess having an open end (34) at the first side and a closed end (36) in the first major face, and the recess having a downwardly-oriented upper wall (38) extending between the open end and the closed end.

18 Claims, 1 Drawing Sheet

(51) Int. Cl.

| | |
|---|---|
| ***B65D 25/20*** | (2006.01) |
| ***B65D 41/16*** | (2006.01) |
| ***B65D 43/16*** | (2006.01) |

(56) References Cited

U.S. PATENT DOCUMENTS

| | | | | | |
|---|---|---|---|---|---|
| 5,713,681 | A | | 2/1998 | Venne et al. | |
| 5,927,533 | A | | 7/1999 | Payne et al. | |
| 6,006,952 | A | * | 12/1999 | Lucas | A47G 19/2266 222/211 |
| D467,506 | S | | 12/2002 | Jones et al. | |
| D512,916 | S | | 12/2005 | Floyd et al. | |
| 7,025,219 | B2 | | 4/2006 | Heisner et al. | |
| D614,501 | S | * | 4/2010 | Fernandez | D9/543 |
| D654,371 | S | * | 2/2012 | Geeraert | D9/685 |
| 2002/0074347 | A1 | | 6/2002 | Murray et al. | |
| 2003/0000912 | A1 | | 1/2003 | Deubel et al. | |
| 2005/0184027 | A1 | | 8/2005 | Floyd et al. | |
| 2005/0211662 | A1 | | 9/2005 | Eaton et al. | |
| 2007/0163990 | A1 | | 7/2007 | Escobosa et al. | |
| 2008/0110854 | A1 | | 5/2008 | Kelly | |
| 2010/0072168 | A1 | | 3/2010 | Kurihara et al. | |

* cited by examiner

BOTTLE

BACKGROUND

The present invention relates to a bottle, and in particular to a bottle having enhanced ergonomic features for containing a personal care composition or an oral care composition.

A large variety of bottles are known in the art for containing a wide variety of products. In the field of personal care compositions such as liquid shampoo, bodywash, shower gel, blow-molded bottles are well known, the bottles typically being composed of a polyester such as polyethylene terephthalate. Such bottles are often used in humid or wet environments, such as in the shower. Furthermore, such bottles may have a large volume, for example at least 330 ml, which means that when filled with the personal care composition the bottle can be somewhat heavy.

There is a need to design such a bottle so as to minimise the possibility of the bottle being inadvertently dropped by the user, in particular when the full bottle is wet, or gripped with a wet hand. In addition, such large bottles require shelf stability so that when the bottles are displayed on a shelf in a supermarket when full, or are stored in a domestic environment, the bottle design can minimise the possibility of the bottle inadvertently falling over.

The present invention aims to provide a bottle which has enhanced ergonomic features, in particular which may be easily held securely by the hand of a user, even if the bottle outer surface or the user's hands are wet, and/or even if the bottle is heavy as a result of having a large volume. The present invention also aims to provide such a bottle which additionally has shelf stability.

BRIEF SUMMARY

The present invention provides a bottle having a base portion including a base wall, a body portion extending upwardly from the base portion, the body portion having a lower end extending from the base portion, a central portion and an upper end, and a neck portion extending upwardly from the upper end, the neck portion providing an outlet opening and a fitting for a closure of the bottle, wherein the body portion comprises first and second major faces, each extending substantially along the length of the body portion, which are opposite to each other and mutually separated on opposite sides of a first central plane of the bottle by a spacing, wherein the spacing decreases proceeding from the lower end to the central portion and from the central portion to the upper end, wherein the body portion further comprises first and second sides, each first and second side connecting the first and second major faces, the bottle further comprising a recess in the first major face, the recess being configured to receive a human thumb, the recess having an open end at the first side and a closed end in the first major face, and the recess having a downwardly-oriented upper wall extending between the open end and the closed end.

In some embodiments, the first central plane extends through a central axis of the outlet opening.

In some embodiments, the recess and the upper wall extend over a second central plane of the bottle which is orthogonal to the first central plane.

In some embodiments, the second central plane extends through a central axis of the outlet opening.

In some embodiments, the recess and the upper wall extend over a majority of a width of the first major face.

In some embodiments, the recess is located in an upper region of the central portion of the first major face, for example in an upper third of the central portion of the first major face.

In some embodiments, the upper wall is located in the upper 10% of the first major face, for example the upper wall being within 10 to 20 mm of the upper end.

In some embodiments, a center line of the recess is inclined upwardly from the open end to the closed end, for example at an angle of from 15 to 45 degrees to the base wall.

In some embodiments, the upper wall is arcuate, being concave towards the recess, and is lower at the open end than at the closed end.

In some embodiments, the upper wall is highest at an elevated portion extending over a second central plane of the bottle which is orthogonal to the first central plane.

In some embodiments, the upper wall has a minimum radius of curvature of 50 mm, optionally within the range of from 60 to 70 mm, over a length of from 50 to 75 mm, and is substantially orthogonal to a central axis of the bottle.

In some embodiments, the recess has an upwardly-oriented lower wall extending between the open end and the closed end.

In some embodiments, the lower wall is arcuate, being convex towards the recess, and is lower at the open end than at the closed end.

In some embodiments, the distance between the upper and lower walls at the open end is greater than the distance between the upper and lower walls at the closed end.

In some embodiments, the first and second major faces taper together in an upward direction, with the first and second major faces each being at an angle of from 1 to 5 degrees to the first central plane.

In some embodiments, the recess has a length from the open end to the closed end, measured substantially along a center line of the recess, of from 30 to 90 mm.

In some embodiments, the recess has a maximum depth relative to the first major face of from 1 to 10 mm.

In some embodiments, the width of the first major face of the bottle, measured along a line substantially extending through the closed end of the recess, is from 60 to 90 mm.

In some embodiments, the depth of the bottle, measured along a line substantially extending through the closed end of the recess, is from 25 to 50 mm.

In some embodiments, the bottle has a capacity of from 300 to 1000 ml, typically from 400 to 800 ml.

In some embodiments, each side extends substantially along the length of the body portion, which first and second sides are opposite to each other.

In some embodiments, the bottle has the recess on each of the first and second major faces, and the recess in the second major face is configured to receive a human thumb, has an open end at the second side and a closed end in the second major face, and has a downwardly-oriented upper wall extending between the open end and the closed end.

In some embodiments, the bottle is rotationally symmetric about a central axis of the outlet opening. In some embodiments, the bottle is reflectionally symmetric about the first central plane extending through the outlet opening.

In some embodiments, the bottle further comprises a second recess in at least one of the first and second major faces, the second recess being configured to receive a human thumb, the second recess respectively having an open end at the first or second side and a closed end in the first or second major face, and the second recess having an upwardly-oriented lower wall extending between the open end and the closed end.

In some embodiments, the bottle further comprises a closure fitted to the neck portion, typically with the recess being wholly beneath the closure.

Typically, the bottle is filled with a personal care composition selected from a liquid shampoo, liquid bodywash or liquid shower gel, or an oral care composition.

In some embodiments, the center of gravity of the filled bottle is located below a center-line of the height of the bottle.

The present invention can therefore provide a bottle which has enhanced ergonomic features, in particular which may be easily held securely by the hand of a user, even if the bottle outer surface or the user's hands are wet, and/or even if the bottle is heavy as a result of having a large volume, and also has shelf stability.

By providing the specifically shaped and configured recess together with upwardly tapering together faces of the bottle, even a large volume bottle can readily be held securely in the hand of a user. The recess receives the thumb and the thumb can be slid into the recess from the side of the bottle to maximise the ability of the hand to wrap around the bottle. The recess can securely hold the thumb, with the upper wall optionally bearing a significant load by interaction with the upper edge of the thumb.

The recess is located at location of the bottle which has been tapered together so as to enhance the ability of a user's hand to wrap around the bottle at the location of the recess.

Even though a tapered bottle would tend to increase the risk of a bottle, particularly when wet or held in a wet hand, to slip downwardly though the grip of the hand, the recess and its configuration and location permit a secure grip of even a heavy, wet bottle.

The bottle of the invention accordingly has particular advantages when the bottle is used to package a personal care composition selected from a liquid shampoo, liquid bodywash, or liquid shower gel which may be used in the shower or bath, or an oral care composition.

The tapered bottle also has shelf stability as a result of a low center of gravity. The tapering configuration can make the center of gravity of the filled bottle to be located below the center-line of the height of the bottle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
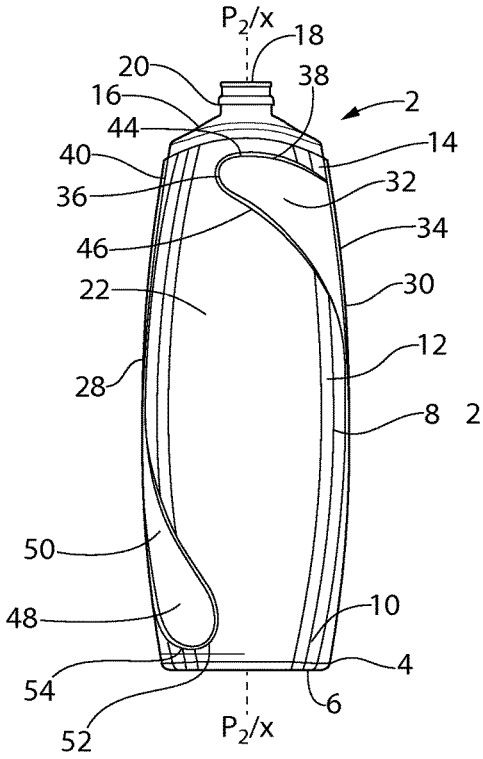
FIG. 1 is a front view of a bottle according to an embodiment of the present invention.
Figure 2:
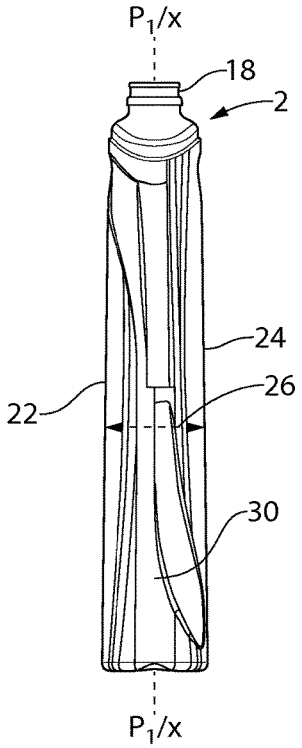
FIG. 2 is a side view of the bottle of FIG. 1.
Figure 3:
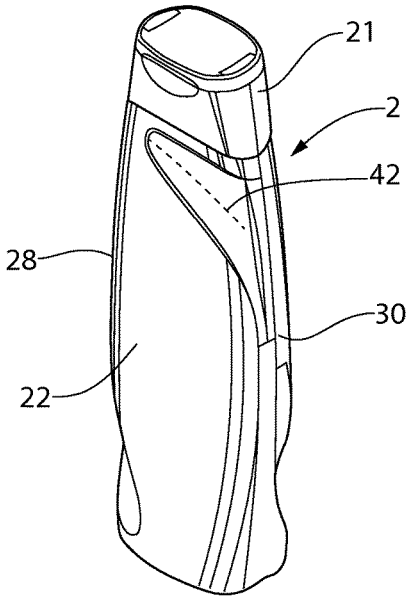
FIG. 3 is a perspective view of the bottle of FIG. 1, with a closure fitted to the bottle.

Referring to FIGS. 1 to 3, there is shown a bottle according to an embodiment of the present invention.

The bottle 2 has a base portion 4 including a substantially planar downwardly-facing base wall 6. A body portion 8 extends upwardly from the base portion 4. The body portion 8 has a lower end 10 extending from the base portion 4. A central portion 12 and an upper end 14 of the body portion 8 are also provided. A neck portion 16 extends upwardly from the upper end 14. The neck portion 16 provides an outlet opening 18 and a fitting 20 for a closure 21 of the bottle 2. The closure 21 is shown in FIG. 3, attached to the bottle 2.

The bottle 2 typically has a capacity of from 300 to 1000 ml, more typically from 400 to 800 ml. The bottle 2 is used to package a personal care composition selected from a liquid shampoo, liquid bodywash, or liquid shower gel which may be used in the shower or bath, or an oral care composition.

The closure 21 is removable or permanently fitted to the neck portion 16. Typically the closure 21 is snap-fitted to the neck portion 16. The closure 21 may include, as illustrated, a hinged lid which may be opened to reveal a pouring orifice (not shown) in the closure 21.

The bottle 2 may be conventionally blow molded from a preform, and may be composed of any suitable moldable polymer, such as polypropylene, polyethylene or polyester such as polyethylene terephthalate. The bottle 2 may be transparent, translucent or opaque.

The body portion 8 comprises first and second major faces 22, 24. Each of the first and second major faces 22, 24 extends substantially along the length of the body portion 8. The first and second major faces 22, 24 are opposite to each other and are mutually separated on opposite sides of a first central plane P1-P1 of the bottle 2 by a spacing 26. The first central plane P1-P1 extends through a central axis X-X of the outlet opening 18.

The spacing 26 decreases proceeding from the lower end 10 to the central portion 12 and from the central portion 12 to the upper end 14. The first and second major faces 22, 24 typically taper together in an upward direction, with the first and second major faces 22, 24 each being at an angle of from 1 to 5 degrees to the first central plane P1-P1. Either or both of the first and second major faces 22, 24 may carry a self-adhesive label (not shown).

The body portion 8 further comprises first and second sides 28, 30. Each of the first and second sides 28, 30 extends substantially along the length of the body portion 8. The first and second sides 28, 30 are opposite to each other. Each of the first and second sides 28, 30 connects the first and second major faces 22, 24.

The bottle 2 further comprises a recess 32 in the first major face 22. The recess 32 is configured to receive a human thumb, for example an adult thumb. The recess 32 is wholly beneath the closure 21 so that when the bottle 2 is open the recess 2 is fully engageable by the thumb. The recess 32 has an open end 34 at the first side 28 and a closed end 36 in the first major face 22. The recess 32 has a downwardly-oriented upper wall 38 extending between the open end 34 and the closed end 36.

The recess 32 and the upper wall 38 extend over a second central plane P2-P2 of the bottle 2 which is orthogonal to the first central plane P1-P1. The second central plane P2-P2 also extends through the central axis X-X of the outlet opening 18, which is along the longitudinal dimension of the bottle 2. The recess 32 and the upper wall 38 extend over a majority of a width of the first major face 22. The recess 32 is located in an upper region 40, typically the upper third, of the central portion 12 of the first major face 22. The upper wall 38 is typically located in the upper 10% of the first major face 22, and typically is within 10 to 20 mm of the upper end 14. The recess 32 has a maximum depth relative to the first major face 22 of from 1 to 10 mm, typically from 1 to 5 mm, for example about 1.8 mm.

A substantially center line 42 of the recess 32 is inclined upwardly from the open end 34 to the closed end 36, typically at an angle of from 15 to 45 degrees to the base wall 6. Preferably, the recess 32 extends inwardly from the right-hand edge of the first major face 22 so that the thumb of the right hand of a user can be accommodated in the recess 32 and the fingers can be placed against the opposite second major face 24.

The upper wall 38 is arcuate, being concave towards the recess 32, and is lower at the open end 34 than at the closed end 36. Typically, the upper wall 38 is highest at an elevated portion 44 extending over the second central plane P2-P2 of the bottle 2.

The recess 32 also has an upwardly-oriented lower wall 46 extending between the open end 34 and the closed end 36. The lower wall 46 is arcuate, being convex towards the recess 32, and is lower at the open end 34 than at the closed end 36. The distance between the upper and lower walls 38, 46 at the open end 34 is greater than the distance between the upper and lower walls 38, 46 at the closed end 36. Consequently, the recess 32 flares outwardly with increasing width from the closed end 36 to the open end 34. The recess 32 has a length from the open end 34 to the closed end 36, measured substantially along the center line 42 of the recess, typically of from 30 to 90 mm, for example from 50 to 75 mm.

The arcuate curvature of the lower wall 46 is greater than the arcuate curvature of the upper wall 38. The upper wall 38 has a minimum radius of curvature of 50 mm, optionally within the range of from 60 to 70 mm, and so is relatively linear over a length of from 50 to 75 mm, and also the upper wall 38 is substantially orthogonal to the central axis X-X. This substantially horizontal and elongate structure of the upper wall 38 provides that a long length of the side of the thumb can comfortably bear against the upper wall 38 when the hand is holding a heavy bottle 2. The increased curvature, and convexity, of the lower wall 46 provides that a user can readily slide their thumb into the recess 32 from the open end prior to achieving a firm and comfortable grip on the bottle 2 using the recess 32.

The width of the first major face 22 of the bottle 2, measured along a line substantially extending through the closed end 36 of the recess 32, is typically from 60 to 90 mm. The depth of the bottle, measured along a line substantially extending through the closed end 36 of the recess 32, is typically from 25 to 50 mm.

In the illustrated embodiment, the bottle 2 has the recess 32 on each of the first and second major faces 22, 24 and the bottle 2 is rotationally symmetric about the central axis X-X of the outlet opening 18. In the illustrated embodiment the recess 32 is shown for use by a right handed thumb, and a rotationally symmetric arrangement provides two opposite right handed recesses 32. Alternatively, the bottle 2 is reflectionally symmetric about the central plane P1-P1 so that the two opposed recesses 32 can be respectively used by the right and left hands of a user.

However, in an alternative embodiment the recess 32 is provided only on the first major face 22 of the bottle 2, and any other two- or three-dimensional shaping may be provided on the second major face 24.

Also, in the illustrated embodiment the first and second major faces 22, 24 are provided with additional two- or three-dimensional shaping in a lower portion of the respective face 22, 24 and diagonally opposite to the respective recess 32, but such shaping may be omitted or of a different two- or three-dimensional shaping. Such shaping may provide a second recess 48 in at least one of the first and second major faces 22, 24, the second recess 48 being configured to receive a human thumb. The second recess 48 has an open end 50 at the first or second side 28, 30 and a closed end 52 in the first or second major face 22, 24, and the second recess 48 has an upwardly-oriented lower wall 54 extending between the open end 50 and the closed end 52. Such a second recess 48 provides support for a thumb when the bottle 2 is inverted, and held by the lower region of the body portion 8.

In addition, in the illustrated embodiment the first and second sides 28, 30 are smoothly arcuately and convexly curved, but in an alternative embodiment may be provided with any other two- or three-dimensional shaping.

Various other modifications of the embodiments of the present invention will readily be apparent to those skilled in the art and are encompassed within the scope of the invention as defined in the appended claims.

What is claimed is:

1. A bottle having a base portion including a base wall, a body portion extending upwardly from the base portion, the body portion having a lower end extending from the base portion, a central portion and an upper end, and a neck portion extending upwardly from the upper end, the neck portion providing an outlet opening and a fitting for a closure of the bottle, wherein the body portion comprises first and second major faces, each extending substantially along the length of the body portion, which are opposite to each other and mutually separated on opposite sides of a first central plane of the bottle by a spacing, wherein the spacing decreases proceeding from the lower end to the central portion and from the central portion to the upper end, wherein the body portion further comprises first and second sides, each first and second side connecting the first and second major faces, the bottle further comprising a first recess in the first major face, the first recess being configured to receive a human thumb, the first recess having an open end at the first side and a closed end in the first major face, and the first recess having a downwardly-oriented upper wall extending between the open end and the closed end, and wherein the bottle further comprises a second recess on the second major face, the second recess being configured to receive a human thumb, and having an open end at the second side and a closed end in the second major face, and having a downwardly-oriented upper wall extending between the open end and the closed end, wherein the upper wall of each of the first and second recesses is arcuate, being concave towards each of the first and second recesses, respectively, and is lower at the respective open end than at the respective closed end.

2. The bottle of claim 1 wherein the first central plane extends through a central axis of the outlet opening.

3. The bottle of claim 1, wherein the first recess and the upper wall of the first recess extend over a second central plane of the bottle which is orthogonal to the first central plane.

4. The bottle of claim 3 wherein the second central plane extends through a central axis of the outlet opening.

5. The bottle of claim 1, wherein the first recess and the upper wall of the first recess extend over a majority of a width of the first major face, and wherein the second recess and the upper wall of the second recess extend over a majority of a width of the second major face.

6. The bottle of claim 1, wherein the first recess is located in an upper region of the central portion of the first major face, and wherein the second recess is located in an upper region of the central portion of the second major face.

7. The bottle of claim 1, wherein the upper wall of each of the first and second recesses has a minimum radius of curvature of 50 mm.

8. The bottle of claim 1 wherein each of the first and second recesses has an upwardly-oriented lower wall extending between the open end and the closed end, wherein the lower wall of each of the respective first and second recesses is arcuate, being convex towards the respective one of the first and second recesses, and is lower at the open end than at the closed end, and wherein the distance between the upper and lower walls of the respective first and second recesses at the open end is greater than the distance between the upper and lower walls of the respective first and second recesses at the closed end.

9. The bottle of claim 1 wherein the first and second major faces taper together in an upward direction, with the first and second major faces each being at an angle of from 1 to 5 degrees to the first central plane.

10. The bottle of claim 1 wherein each of the first and second recesses has a length from the open end to the closed end, measured substantially along a center line of each of the first and second recesses, of from 30 to 90 mm.

11. The bottle of claim 1 wherein each of the first and second recesses has a maximum depth relative to the first major face of from 1 to 10 mm.

12. The bottle of claim 1 wherein the width of the first major face of the bottle, measured along a line substantially extending through the closed end of each of the first and second recesses, is from 60 to 90 mm.

13. The bottle of claim 1 wherein the depth of the bottle, measured along a line substantially extending through the closed end of the recess, is from 25 to 50 mm.

14. The bottle of claim 1 wherein each side extends substantially along the length of the body portion, which first and second sides are opposite to each other.

15. The bottle of claim 8 wherein the bottle is rotationally symmetric about a central axis of the outlet opening.

16. The bottle of claim 8 wherein the bottle is reflectionally symmetric about the first central plane extending through the outlet opening.

17. The bottle of claim 1 further comprising a third recess in at least one of the first and second major faces, the third recess being configured to receive a human thumb, the third recess having an open end at the first or second side and a closed end in the first or second major face, and the third recess having an upwardly-oriented lower wall extending between the open end and the closed end.

18. The bottle of claim 1 wherein the bottle is filled with a personal care composition selected from a liquid shampoo, liquid bodywash or liquid shower gel, or an oral care composition.

* * * * *